United States Patent [19]

Fuchs, Jr.

[11] 4,072,037

[45] Feb. 7, 1978

[54] APPARATUS AND METHODS FOR FORMING A PLURALITY OF ELONGATED MEMBERS

[75] Inventor: Francis Joseph Fuchs, Jr., Princeton Junction, N.J.

[73] Assignee: Western Electric Co., Inc., New York, N.Y.

[21] Appl. No.: 777,244

[22] Filed: Mar. 14, 1977

Related U.S. Application Data

[63] Continuation-in-part of Ser. No. 638,495, Dec. 8, 1975, abandoned.

[51] Int. Cl.[2] ..... B21C 33/00; B21C 25/02; B21C 23/00

[52] U.S. Cl. ..... 72/261; 72/467; 72/468; 425/463

[58] Field of Search ..... 72/253, 260, 261, 262, 72/468, 467; 425/461, 463

[56] References Cited

U.S. PATENT DOCUMENTS

| | | | |
|---|---|---|---|
| 3,321,950 | 5/1967 | Gettig | 72/255 |
| 3,394,579 | 7/1968 | Hall et al. | 72/261 |
| 3,901,065 | 8/1975 | Schmehl | 72/468 |

FOREIGN PATENT DOCUMENTS

| | | | |
|---|---|---|---|
| 937,383 | 3/1948 | France | 72/261 |

*Primary Examiner*—C.W. Lanham
*Assistant Examiner*—D. M. Gurley
*Attorney, Agent, or Firm*—A. S. Rosen

[57] ABSTRACT

A plurality of separate, elongated, metallic members, such as wires, are formed simultaneously, e.g., through the application of hydrostatic extrusion techniques, by passing a single metallic workpiece through a die with a plurality of apertures. The apertures extend longitudinally through the die from an entry wall of the die, and are so arrayed, and the die entry wall includes surfaces whch are so configured, as to cooperate to create cross-shear stresses in the material of the workpiece in the vicinity of the apertures. These cross-shear stresses separate, or assist in separating, the workpiece into a plurality of elongated members, so that the forming process may take place at reduced operating pressures.

18 Claims, 12 Drawing Figures

FIG. 1
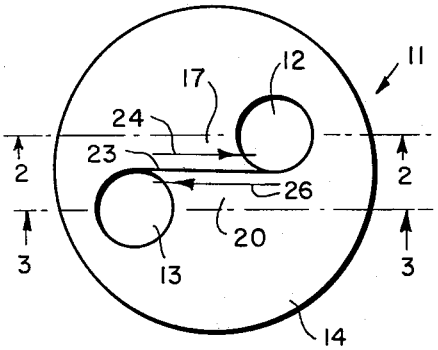
FIG. 4
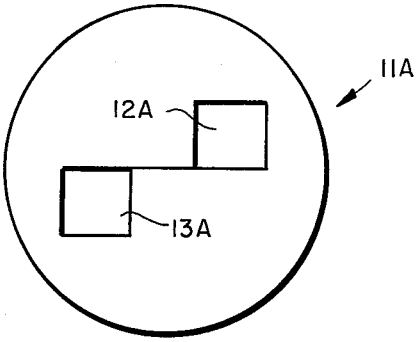
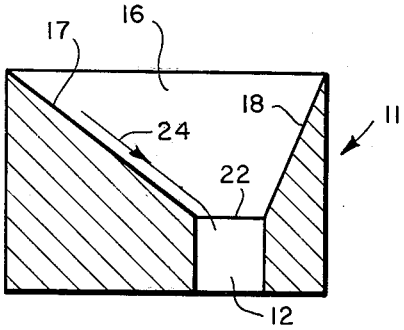
FIG. 2
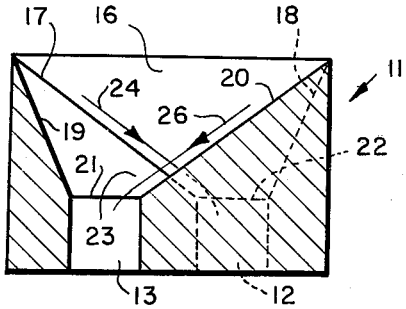
FIG. 3
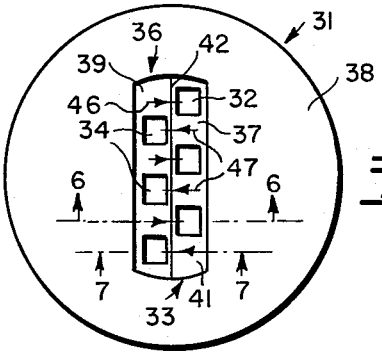
FIG. 5
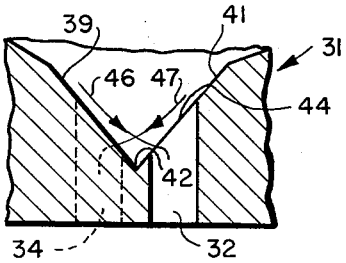
FIG. 6
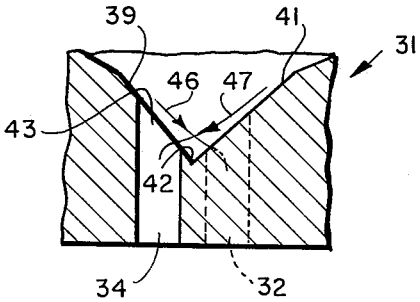
FIG. 7

FIG. 8
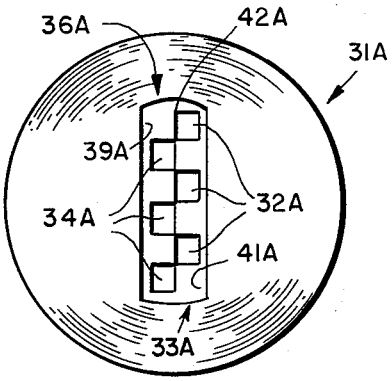
FIG. 9
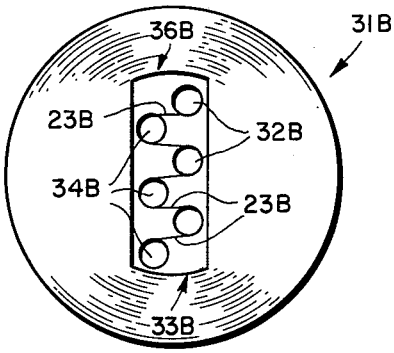
FIG. 10
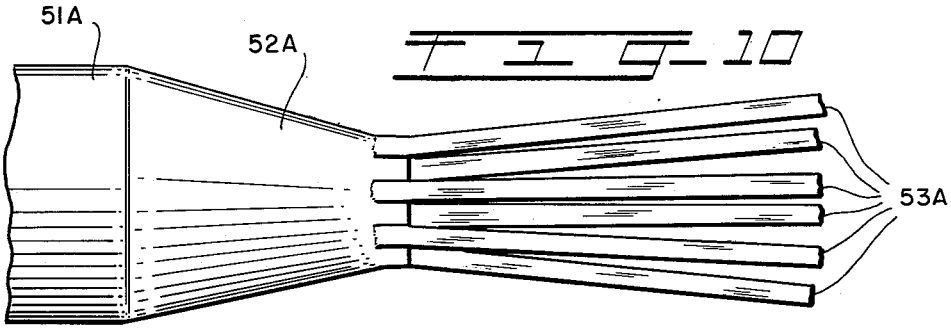
FIG. 11
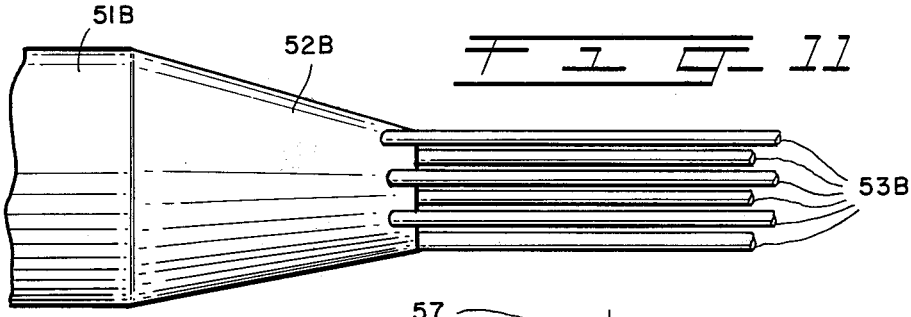
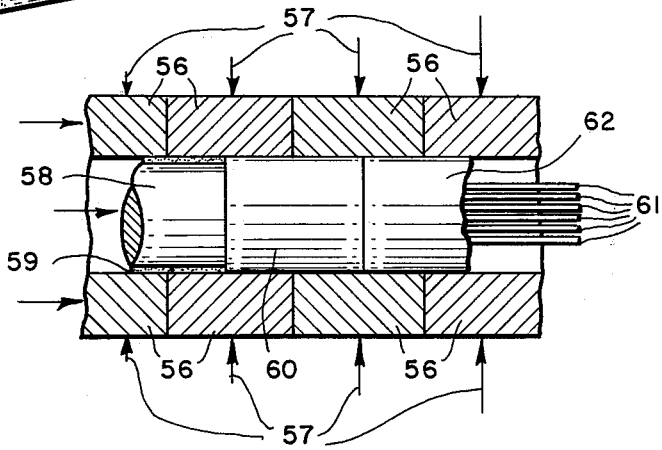
FIG. 12

APPARATUS AND METHODS FOR FORMING A PLURALITY OF ELONGATED MEMBERS

RELATED APPLICATION

This patent application is a continuation-in-part of a copending application, Ser. No. 638,495, filed Dec. 8, 1975, now abandoned.

BACKGROUND OF THE INVENTION

1. Field of the Invention

This invention relates to apparatus and methods for forming a plurality of elongated members and, more particularly, to apparatus and methods for deforming a single metallic workpiece so as to produce a plurality of elongated, metallic members simultaneously.

2. Description of the Prior Art

In the art of forming elongated, metallic members, it is known to utilize hydrostatic extrusion techniques, wherein hydrostatic pressure is applied to a metallic billet within a chamber, such that the material of the billet is rendered more ductile, as the billet is forced through an aperture in a die located at one end of the chamber. Some examples of such techniques may be found in my U.S. Pat. No. R. 28,795 and U.S. Pat. No. 3,985,011, wherein a continuous hydrostatic extrusion process is employed.

It is also known in such art to provide apparatus which includes a die having a plurality of apertures extending in parallel therethrough, and to force a metallic workpiece through such die so as to produce simultaneously a plurality of elongated, metallic members. For example, such dies are disclosed in U.S. Pat. No. 3,901,065 to G. L. Schmehl and in my U.S. Pat. No. 3,948,079.

In my copending application, entitled, "Apparatus and Methods for Forming Multiple Elongated Products", Ser. No. 638,493, filed, concurrently with the parent application to this continuation-in-part application, on Dec. 8, 1975, a number of aperture arrangements for multiple aperture dies are suggested, in order to provide a relatively free flow of a hydrostatic medium, which acts as a lubricant, to each of the die apertures. Such arrangements may involve the arraying of the apertures along a straight line or a shallow curve, such as a shallow "S"-shaped curve.

While the simultaneous hydrostatic extrusion of a plurality of elongated, metallic members has indeed been achieved, for example, as disclosed in U.S. Pat. No. 3,901,065 to G. L. Schmehl, in my U.S. Pat. No. 3,948,079, and in my copending application, Ser. No. 638,493, all of which have been mentioned previously, very high pressures are necessary to the performance of such hydrostatic extrusion. At such high pressures, sealing problems may be encountered, as well as increased costs in creating, supporting and maintaining the very high pressures in the hydrostatic medium utilized. Clearly, the provision of apparatus and methods for producing a plurality of elongated, metallic members simultaneously, through the performance of hydrostatic extrusion techniques at reduced operating pressures, would be quite advantageous to the art of forming elongated, metallic members.

BRIEF SUMMARY OF THE INVENTION

The invention contemplates workpiece deforming instrumentalities which include dies so structured as to reduce the operating pressures required to form a plurality of elongated, metallic members simultaneously from a single, metallic workpiece, and the use of such instrumentalities in so forming the elongated, metallic members at reduced pressures. An improved die of the type utilized in accordance with the invention includes a plurality of apertures which extend longitudinally through the die from an entry wall of the die, with the apertures being so arrayed, and the die entry wall including surfaces which are so configured, that cross-shear stresses are established in the material of the workpiece between adjacent die apertures as the workpiece is forced against the die entry wall. These cross-shear stresses separate, or aid in separating, the material of the workpiece into a plurality of individual elements, which individual elements thereupon pass through the die apertures and become the desired elongated members. Thus, reduced pressures may be employed in forcing the workpiece through the die.

A die structure which has been found most advantageous in establishing the desired cross-shear stresses involves a die body which includes first and second longitudinally extending apertures, each of which apertures has an entrance end located along an entry wall of the die body. The die entry wall includes first and second entry surfaces, with the first entry surface being positioned laterally adjacent to the entrance end of the second aperture while sloping past the entrance end of the second aperture and toward the entrance end of the first aperture, and with the second entry surface being positioned laterally adjacent to the entrance end of the first aperture while sloping past the entrance end of the first aperture and toward the entrance end of the second aperture. Thus, a substantial part of the flow of the metallic material in a single metallic workpiece which is forced against the die entry wall will be directed along two neighboring flow paths following the first and second entry surfaces, with the first entry surface directing a first portion of the metallic material past the second aperture and into the first aperture, and with the second entry surface directing a second portion of the metallic material past the first aperture and into the second aperture, thereby providing the required cross-shear stress pattern.

In another aspect of the invention, first and second pluralities of closely spaced apertures, which extend longitudinally through a die, may be arrayed along two adjacent, transversely extending rows. The apertures in one of the rows are so offset into positions opposite the spaces between the apertures of the other row as to provide a staggered relationship of closely proximate, discrete apertures. The apertures in each such row may be round, or may advantageously have a square or rectangular configuration, with adjacent apertures preferably substantially abutting one another along adjacent corners. Appropriately configured die entry wall surfaces are provided, in similar manner to the provision of the previously described, first and second entry surfaces. During the extrusion of a workpiece through such a die in accordance with the techniques of the invention, cross-shear stresses of significant magnitudes will be established in the locations of closest proximity between adjacent die apertures, permitting such extrusion to take place at relatively low pressure levels.

BRIEF DESCRIPTION OF THE DRAWING

FIG. 1 of the drawing is an end view showing a first embodiment of a plural aperture die which may be employed, in accordance with the principles of the invention, in forming a plurality of separate, elongated, metallic members upon the forcing of a single metallic workpiece through the die apertures at a relatively low operating pressure utilizing, e.g., hydrostatic extrusion techniques, such first die embodiment providing two discrete apertures of round configuration;

FIGS. 2 and 3 are cross-sectional views of the die of FIG. 1, taken along the lines 2—2 and 3—3, respectively, in FIG. 1, such views further illustrating certain entry surfaces along an entry wall of the die of FIG. 1;

FIG. 4 is an end view showing an alternative die embodiment, providing two discrete apertures of square configuration, which may be employed in similar manner to the use of the die of FIG. 1;

FIG. 5 is an end view showing another alternative die embodiment, providing two adjacent rows of discrete, non-contacting, square apertures, which may be employed in similar manner to the use of the die of FIG. 1;

FIGS. 6 and 7 are enlarged, cross-sectional views of portions of the die of FIG. 5, taken along the lines 6—6 and 7—7, respectively, in FIG. 5, such views further illustrating certain entry surfaces along an entry wall of the die of FIG. 5;

FIGS. 8 and 9 are end views showing two further alternative die embodiments, providing two adjacent rows of discrete, corner-contacting, square apertures, and two adjacent rows of discrete, non-contacting, round apertures, respectively, each of which further alternative die embodiments may be employed in similar manner to the use of the die of FIG. 1;

FIGS. 10 and 11 are longitudinal views of portions of two metallic workpieces, and of a plurality of separate, elongated, metallic members formed from each of the two metallic workpieces, through the use of the dies of FIGS. 8 and 9, respectively; and FIG. 12 is a longitudinal view, partly in section, of portions of apparatus which may be employed to force metallic workpieces against and through multiple aperture dies, such as the dies of FIGS. 1-9, in order to form a plurality of separate, elongate, metallic members simultaneously.

DETAILED DESCRIPTION

Referring first to FIG. 1 of the drawing, a die 11 has a first aperture 12 and a second aperture 13, the two apertures 12 and 13 extending longitudinally through the body of the die. The apertures 12 and 13 may be round in configuration, as shown in FIG. 1 for the die 11, or of any other desired configuration. For example, rectangular or square apertures may be provided, as shown in FIG. 4 with respect to two apertures 12A and 13A which extend longitudinally through a die 11A.

The die 11 includes a die entry wall 14, which constitutes that part of the die 11 which may be seen in the end view of FIG. 1 surrounding the apertures 12 and 13. The entry wall 14 includes several surfaces, such as the surfaces 16, 17, 18, 19 and 20 identified in FIGS. 2 and 3 of the drawing. Of these surfaces of the entry wall 14, the most significant with respect to the subject invention are a first entry surface 17 and a second entry surface 20. The first entry surface 17, as may be seen in FIGS. 1-3, extends at least from a position laterally adjacent to an entrance end 21 of the second aperture 13, but spaced somewhat axially from such entrance end 21 of the second aperture 13, to an entrance end 22 of the first aperture 12, while sloping past the entrance end 21 of the second aperture 13 and toward the entrance end 22 of the first aperture 12. Similarly, the second entry surface 20 extends at least from a position laterally adjacent to the entrance end 22 of the first aperture 12, but spaced somewhat axially from the entrance end 22 of the first aperture 12, to the entrance end 21 of the second aperture 13, while sloping past the entrance end 22 of the first aperture 12 and toward the entrance end 21 of the second aperture 13. An axially or longitudinally extending wall surface 23 (FIG. 3) joins adjacent lateral edges of the first and second entry surfaces 17 and 20 in the vicinity of the entrance end 21 of the second aperture 13. A like, but oppositely facing, longitudinally extending wall surface, hidden from view in FIG. 3 but substantially coplanar with the wall surface 23, joins the adjacent lateral edges of the first and second entry surfaces 17 and 20 in the vicinity of the entrance end 22 of the first aperture 12. These two substantially coplanar, longitudinally extending wall surfaces are represented in the end view of FIG. 1 by a line, also carrying the wall surface identifying numeral 23, which extends between the respective entrance ends 22 and 21 of the first and second apertures 12 and 13.

The arrangement of the first and second apertures 12 and 13 and of the first and second entry surfaces 17 and 20, as thus far described, is designed to introduce a pattern of cross-shear stresses into a single metallic workpiece, upon the forcing of the workpiece against the die entry wall 14. The cross-shear stresses will serve to separate, or assist in separating, the metallic material of the workpiece into two portions, a different one of which will thereupon pass through each of the apertures 12 and 13. Thus, such creation of a pattern of cross-shear stresses will permit the metal deformation process to take place at reduced operating pressures. In particular, upon such forcing of the single metallic workpiece against the die entry wall 14, a substantial part of the flow of the metallic material will be directed along two neighboring flow paths following the first and second entry surfaces 17 and 20, with the first entry surface 17 directing a first portion of the metallic material, represented by arrow 24 in FIGS. 1-3 of the drawing, past the second aperture 13 and into the first aperture 12, and with the second entry surface 20 directing a second portion of the metallic material, represented by arrow 26, past the first aperture 12 and into the second aperture 13. The resulting pattern of cross-shear stresses in the metallic material may be appreciated by observing the substantial crossing of the neighboring arrows 24 and 26 in FIGS. 1 and 3. This stress pattern resembles the patterns of stresses which are introduced into metallic or other workpieces by conventional shearing devices.

Turning now to FIGS. 5-7 of the drawing, the principle of creating a cross-shear stress pattern between two adjacent apertures in a die can be expanded so as to apply to a multiple aperture die configuration. Thus, the die 31 of FIG. 5 includes a number of discrete apertures, each of which apertures extends longitudinally through the body of the die 31. In particular two groups or pluralities of apertures are utilized, a first plurality of apertures, apertures 32,32, being arrayed along a first row 33, and a second plurality of apertures, apertures 34,34, being arrayed along a second row 36. The apertures 34,34 of the second plurality are so offset into positions opposite the spaces 37,37 between the apertures 32,32 of the first plurality as to establish a staggered relationship of closely spaced, discrete apertures, i.e., the relationship illustrated in FIG. 5 of the drawing. More particularly, the apertures 32,32 or 34,34 in each row 33 or 36 are located in positions opposite the spaces between the apertures 34,34 or 32,32 in the other row 36 or 33, i.e., all of the apertures 32,32 or 34,34 are so located except for one endmost aperture 32 or 34 in each of the rows 33 and 36, which one endmost aperture 32 or 34 in each row 33 or 36 is situated opposite a location outward of a single adjacent aperture 34 or 32 in the other row 36 or 33.

The die 31 includes a die entry wall 38, which constitutes that part of the die 31 which may be seen in the end view of FIG. 5 surrounding the staggered relationship of the apertures 32,32 and 34,34. The entry wall 38 tapers inwardly along two significant surfaces, namely a first entry surface 39 and a second entry surface 41, which may intersect along a line 42 generally intermediate the first and second rows 33 and 36. The first entry surface 39 includes entrance ends 43,43 of the second plurality of apertures 34,34 in the second row 36, while the second entry surface 41 includes entrance ends 44,44 of the first plurality of apertures 32,32 in the first row 33. Each of the first and second entry surfaces 39 and 41 may be substantially planar. The arrangement of the various apertures 32,32 and 34,34 cooperates with the configuration of the first and second entry surfaces 39 and 41 such that the flow of the metallic material in a single metallic workpiece, forced against the die entry wall 38, will be generally directed along two intersecting flow paths, following the first and second entry surfaces 39 and 41 while flowing across the second and first aperture rows 36 and 33, respectively, with the first entry surface 39 directing those elements of the metallic material, represented by arrows 46,46 in FIGS. 5–7 of the drawing, which traverse the spaces between the apertures 34,34 of the second plurality into the apertures 32,32 of the first plurality, and with the second entry surface 41 simultaneously directing those elements of the metallic material, represented by arrows 47,47, which traverse the spaces 37,37 between the apertures 32,32 of the first plurality into the apertures 34,34 of the second plurality. The resulting pattern of cross-shear stresses in the metallic material may be appreciated by observing the substantial crossing of the two sets of arrows 46,46 and 47,47 in FIGS. 5–7.

Referring next to FIG. 8 of the drawing, another alternative embodiment of the invention is illustrated by a die 31A which includes first and second pluralities 32A,32A and 34A,34A of discrete apertures, arrayed in first and second rows 33A and 36A along second and first entry surfaces 41A and 39, respectively. The structure, as described thus far, is similar to that of the die 31 of FIGS. 5–7. As may be seen in FIG. 8, however, the arrangement of the apertures 32A,32A and 34A,34A in the die 31A, all of which apertures are of rectangular, e.g., square configuration, is such that a substantial abutting relationship exists between adjacent rectangular apertures, one in each of the first and second rows 33A and 36A, along adjacent right angle corners of the adjacent apertures, with the first and second entry surfaces 39A and 41A intersecting along a line 42A which includes such adjacent right angle corners. During the forcing of a single metallic workpiece against and through the die 31A, cross-shear stresses will be created in the metallic material of the workpiece in the manner previously described concerning the die 31 of FIGS. 5–7. Such cross-shear stresses will be quite pronounced in the vicinity of the adjacent right-angle corners. The cross-shear stresses will separate, or will aid in separating, the metallic material of the workpiece into a number of separate elements of square cross section. Each of these separate elements will pass through a different one of the apertures 32A,32A and 34A,34A, and will constitute one of a plurality of separate, elongated, metallic members of square cross section simultaneously being formed.

Turning now to FIG. 9 of the drawing, still another alternative die embodiment is illustrated. Die 31B has first and second pluralities of discrete apertures 32B,32B and 34B,34B extending longitudinally through the body of the die. The apertures 32B,32B and 34B,34B are arrayed in two parallel, transversely extending rows 33B and 36B, in a pattern similar to that of die 31 of FIGS. 5–7. The apertures 32B,32B and 34B,34B are each of round configuration, such that die 31B may form a number of round elongated products. Each line 23B,23B which may be seen in FIG. 9 joining adjacent apertures 32B and 34B, one in each row 33B or 36B, corresponds to the line 23 in FIG. 1 which represents the longitudinal extending wall surface 23 of FIG. 3. The apertures 33B and 36B are preferably spaced as closely together as possible. Thus, cross-shear stresses of significant magnitudes will be established in the material of a single metallic workpiece forced against and through die 31B. Such cross-shear stresses will follow the general pattern previously discussed, and will aid in reducing the pressures required to force the workpiece against and through die 31B by causing or assisting in a shearing apart of the material of the workpiece during deformation of the workpiece.

Referring next to FIGS. 10 and 11 of the drawing, these represent, respectively, the condition of a single metallic workpiece 51A or 51B undergoing deformation in the respective die 31A or 31B of FIG. 8 or FIG. 9. As each workpiece 51A or 51B enters into a conical mouth portion of the die 31A or 31B, its diameter is caused to decrease continuously along an initial deformation zone 52A or 52B, until the workpiece reaches the immediate vicinity of the die apertures 32A,32A and 34A,34A or 32B,32B and 34B,34B. The previously mentioned cross-shear stresses, e.g., in the vicinity of the first and second entry surface 39A and 41A of die 31A in FIG. 8, thereupon reach sufficient magnitude to effect, or to assist in effecting, separation of the material of workpiece 51A or 51B into a number of separate, elongated, metallic members 53A or 53B which thereupon exit through the apertures 32A,32A and 34A,34A or 32B,32B and 34B,34B of die 31A or 31B.

Turning now to FIG. 12 of the drawing, there are illustrated pertinent portions of a preferred apparatus for utilizing appropriate dies, constructed in accordance with the principles of the invention, such as the dies 31A and 31B, to form a plurality of elongated products, such as the elongated products 53A and 53B, at reduced operating pressures. This apparatus is more fully described in my previously mentioned U.S. Pat. No. 3,985,011. The apparatus includes a number of gripping element sectors 56,56 which are advanced from left to right as illustrated in FIG. 12. As the sectors 56,56 advance toward the right, they are subjected to a continually increasing compressive pressure, as indicated by arrows 57,57 which increase in size from left to right.

A single metallic workpiece 58, for example, a copper or aluminum rod of indefinite length, has its outer periphery coated with a hydrostatic medium 59. Shear stresses transmitted through the hydrostatic medium 59, which may be beeswax or polyethylene wax, serve to advance the workpiece 58 from left to right in FIG. 12 with the advancing sectors 56,56. At the same time, compressive stresses of continually increasing magnitude are also imposed upon the advancing workpiece, thereby rendering the workpiece considerably more ductile and more suited to extrusion. The hydrostatic medium 59, in addition to its ability to act as a shear transmitting medium, has lubricative properties, and serves to lubricate the apertures in a die 60 through which the workpiece 58 is extruded, thereby reducing the axial forces required for extrusion. Such extrusion takes place, with the workpiece 58 rendered suitably ductile by the compressive pressures exerted upon it, as the workpiece is forced against die 60 and through its apertures, by shear forces in the hydrostatic medium 59, so as to form a plurality of elongated products 61,61. Die 60, which is carried on a suitable die stem 62, may, of course, be either of the dies 31A or 31B, may be any of the dies 11,11A and 31, or may be any other suitable die constructed in accordance with the principles of the invention It is to be understood that the described apparatus and methods are simply illustrative of preferred embodiments of the invention. It should be clear that various other embodiments might incorporate die apertures of different shapes, e.g., non-square rectangles, with or without contact between adjacent corners of adjacent apertures, and/or might employ equivalent arrays of apertures for producing the desired cross-shear stresses, e.g., curved paths rather than linear rows of apertures, and/or might employ any other appropriate mechanism for forcing a single metallic workpiece through a plural aperture die, e.g., the apparatus disclosed in my copending application, entitled, "Apparatus and Methods for Continuous Extrusion," Ser. No. 664,611, filed Mar. 8, 1976. Many other modifications may be made in accordance with the principles of the invention.

What is claimed is:

1. Apparatus for deforming a single metallic workpiece to produce simultaneously a plurality of elongated, metallic members, said apparatus comprising:

a die having an entry wall at one end thereof, and having first and second apertures extending longitudinally therethrough with an entrance end of each aperture located along said entry wall;

said entry wall including first and second entry surfaces, the first entry surface being positioned laterally adjacent to the entrance end of the second aperture while sloping past the entrance end of the second aperture and toward the entrance end of the first aperture, and the second entry surface being positioned laterally adjacent to the entrance end of the first aperture while sloping past the entrance end of the first aperture and toward the entrance end of the second aperture, such that a substantial part of the flow of the metallic material in a single metallic workpiece, forced against the entry wall, will be directed along two neighboring flow paths following said first and second entry surfaces, with the first entry surface directing a first portion of the metallic material past the second aperture and into the first aperture, and with the second entry surface directing a second portion of the metallic material past the first aperture and into the second aperture, so as to introduce a pattern of cross-shear stresses into the metallic material as said single metallic workpiece is forced against said entry wall; and means for forcing the single metallic workpiece against said entry wall with sufficient pressure to cause said first and second portions of the metallic workpiece to pass, respectively, through the first and second apertures simultaneously as the metallic material of the workpiece separates under the influence of said cross-shear stresses, such that a plurality of elongated, metallic members are formed.

2. Apparatus as set forth in claim 1, wherein said first and second apertures are spaced from one another, said die further including longitudinally extending wall means for separating said first and second entry surfaces between said first and second apertures.

3. Apparatus as set forth in claim 1, wherein each of said first and second apertures has a rectangular configuration, with adjacent rectangular apertures substantially abutting one another along adjacent corners thereof.

4. Apparatus as set forth in claim 3, wherein each of said first and second apertures has a square configuration.

5. Apparatus as set forth in claim 1, wherein said die further comprises:

at least one additional first aperture and at least one additional second aperture, said additional first and additional second apertures extending longitudinally through the die with each additional first or additional second aperture having an entrance end thereof located along said entry wall;

the entrance ends of said first aperture and of each said additional first aperture being arrayed along a first row, and the entrance ends of said second aperture and of each said additional second aperture being arrayed along a second row adjacent to said first row, with the apertures having the entrance ends thereof arrayed along said second row being so offset into positions opposite the apertures having the entrance ends thereof arrayed along said first row as to establish a staggered relationship of closely proximate apertures; and a plurality of additional entry surfaces, each associated with a different one of said additional first and additional second apertures, with each of said first entry surface, said second entry surface and said additional entry surfaces sloping toward the entrance end, respectively, of said first aperture, said second aperture, or said associated one of said additional first and additional second apertures, while sloping past the entrance end of at least one of said first, second, additional first, and additional second apertures, laterally adjacent thereto.

6. Apparatus as set forth in claim 5, wherein:

said first entry surface, and each said additional entry surface associated with one of said additional first apertures, are all substantially coplanar; and said second entry surface, and each said additional entry surface associated with one of said additional second apertures, are all substantially coplanar.

7. Apparatus as set forth in claim 5, wherein said first aperture, said second aperture, each of said additional first apertures, and each of said additional second apertures, all have rectangular configurations, with adjacent rectangular apertures substantially abutting one another along adjacent corners thereof.

8. Apparatus as set forth in claim 5, wherein said first aperture, said second aperture, each of said additional first apertures and each of said additional second apertures, all have square configurations, with adjacent square apertures substantially abutting one another along adjacent corners thereof.

9. Apparatus for deforming a single metallic workpiece to produce simultaneously a plurality of elongated, metallic members, said apparatus comprising:

a die having an entry wall at one end thereof, and having first and second pluralities of closely spaced apertures extending longitudinally therethrough with an entrance end of each aperture located along said entry wall, the entrance ends of said first and second pluralities of apertures being arrayed along respective first and second, transversely extending rows located adjacent to one another, the apertures of said second plurality being so offset into positions opposite the spaces between the apertures of said first plurality as to establish a staggered relationship of closely proximate apertures;

said entry wall tapering inwardly past said entrance ends of said apertures along first and second, intersecting entry surfaces which include said second and first rows, respectively, such that the flow of the metallic material in a single metallic workpiece, forced against said entry wall, will be generally directed along two intersecting flow paths, following said first and second entry surfaces while flowing across said respective second and first rows, with said first entry surface directing those elements of the metallic material which traverse the spaces between the apertures of said second plurality into the apertures of said first plurality, and with said second entry surface simultaneously directing those elements of the metallic material which traverse the spaces between the apertures of the first plurality into the apertures of the second plurality, so as to introduce a pattern of cross-shear stresses into the metallic material as the metallic material traverses said staggered relationship of closely proximate apertures, as said single metallic workpiece is forced against said entry wall; and means for forcing the single metallic workpiece against said entry wall with sufficient pressure to cause different portions of the metallic workpiece to pass through each of the apertures of said first and second pluralities of apertures simultaneously as the metallic material of the workpiece separates under the influence of said cross-shear stresses, such that a plurality of elongated, metallic members are produced.

10. Apparatus as set forth in claim 9, wherein each of said apertures is round.

11. Apparatus as set forth in claim 9, wherein each of said apertures has a rectangular configuration, with adjacent rectangular apertures substantially abutting one another along adjacent corners thereof, substantially on a line of intersection between said first and second entry surfaces.

12. Apparatus as set forth in claim 11, wherein each of said rectangularly configured apertures has a square configuration.

13. A die for use in deforming a single metallic workpiece to produce simultaneously a plurality of elongated, metallic members, said die comprising:

a die body having an entry wall at one end thereof, and having first and second apertures extending longitudinally therethrough with an entrance end of each aperture located along said entry wall;

said entry wall including first and second entry surfaces, the first entry surface being positioned laterally adjacent to the entrance end of the second aperture while sloping past the entrance end of the second aperture and toward the entrance end of the first aperture, and the second entry surface being positioned laterally adjacent to the entrance end of the first aperture while sloping past the entrance end of the first aperture and toward the entrance end of the second aperture, such that a substantial part of the flow of the metallic material in a single metallic workpiece, forced against the entry wall, will be directed along two neighboring flow paths following said first and second entry surfaces, with the first entry surface directing a first portion of the metallic material past the second aperture and into the first aperture, and with the second entry surface directing a second portion of the metallic material past the first aperture and into the second aperture, so as to introduce a pattern of cross-shear stresses into the metallic material as said single metallic workpiece is forced against said entry wall.

14. A die for use in deforming a single metallic workpiece to produce simultaneously a plurality of elongated, metallic members, said die comprising:

a die body having an entry wall at one end thereof, and having first and second pluralities of closely spaced apertures extending longitudinally therethrough with an entrance end of each aperture located along said entry wall, the entrance ends of said first and second pluralities of apertures being arrayed along respective first and second, transversely extending rows located adjacent to one another, the apertures of said second plurality being so offset into positions opposite the spaces between the apertures of said first plurality as to establish a staggered relationship of closely proximate apertures;

said entry wall tapering inwardly past said entrance ends of said apertures along first and second, intersecting entry surfaces which include said second and first rows, respectively, such that the flow of the metallic material in a single metallic workpiece, forced against said entry wall, will be generally directed along two intersecting flow paths, following said first and second entry surfaces while flowing across said respective second and first rows, with said first entry surface directing those elements of the metallic material which traverse the spaces between the apertures of the second plurality into the apertures of the first plurality, and with said second entry surface simultaneously directing those elements of the metallic material which traverse the spaces between the apertures of the first plurality into the apertures of the second plurality, so as to introduce a pattern of cross-shear stresses into the metallic material as the metallic material traverses said staggered relationship of closely proximate apertures as said single metallic workpiece is forced against said entry wall.

15. A die as set forth in claim 14, wherein each of said apertures has a rectangular configuration, with adjacent rectangular apertures substantially abutting one another along adjacent corners thereof, substantially on a line of intersection between said first and second entry surfaces.

16. A method of deforming a single metallic workpiece to produce simultaneously a plurality of elongated, metallic members, said method comprising:

a. forcing the single metallic workpiece against an entry wall of a die, which die has a first aperture and a second aperture extending longitudinally therethrough, said die entry wall sloping past an entrance end of said second aperture and toward an entrance end of said first aperture along a first entry surface, and sloping past said entrance end of said first aperture and toward said entrance end of said second aperture along a second entry surface differing from said first entry surface; thereby simultaneously b. guiding the flow of the metallic material of the single metallic workpiece such that a substantial part of said flow is directed along two neighboring flow paths, one of the two neighboring flow paths following said first entry surface while extending past said entrance end of the second aperture and into said entrance end of the first aperture, and the other of the two neighboring flow paths following said second entry surface while extending past said entrance end of the first aperture and into said entrance end of the second aperture.

17. A method as set forth in claim 16, wherein said die has a number of additional apertures extending longitudinally therethrough, arranged with entrance ends thereof arrayed intersecting said first entry surface along a first row, said first row including the entrance end of said first aperture, and intersecting said second entry surface along a second row, said second row including the entrance end of said second aperture, the apertures with entrance ends thereof intersecting said second entry surface along said second row being so offset into positions opposite spaces between the apertures with entrance ends thereof intersecting said first entry surface along said first row as to establish a staggered relationship of closely proximate apertures, the method further comprising:

c. guiding the flow of the metallic material of the single metallic workpiece, with respect to each pair of adjacent, closely proximate apertures, in the manner of step (b).

18. A method of deforming a single metallic workpiece to produce simultaneously a plurality of elongated, metallic members, said method comprising:

a. aligning the single metallic workpiece with a die having an entry wall at one end thereof, and having first and second pluralities of closely spaced apertures extending longitudinally therethrough with an entrance end of each aperture located along said entry wall, the entrance ends of said first and second pluralities of apertures being arrayed along respective first and second, transversely extending rows located adjacent to one another, the apertures of said second plurality being so offset into positions opposite the spaces between the apertures of said first plurality as to establish a staggered relationship of closely proximate apertures, said entry wall tapering inwardly past the entrance ends of the apertures along first and second, intersecting entry surfaces which include said second and first rows, respectively; and b. forcing the single metallic workpiece against said entry wall with sufficient pressure to cause the flow of metallic material in the workpiece to be generally directed along two intersecting flow paths, following said first and second entry surfaces while flowing across said respective second and first rows, with said first entry surface directing those elements of the metallic material which traverse the spaces between the apertures of the second plurality into the apertures of the first plurality, and with said second entry surface simultaneously directing those elements of the metallic material which traverse the spaces between the apertures of the first plurality into the apertures of the second plurality, as the metallic material of the workpiece separates under the influence of cross-shear stresses, such that a plurality of elongated, metallic members are produced.

* * * * *